US006942489B2

(12) United States Patent
Tiesler

(10) Patent No.: US 6,942,489 B2
(45) Date of Patent: Sep. 13, 2005

(54) DOCKABLE CONNECTION ASSEMBLY

(75) Inventor: John M. Tiesler, Harrison Township, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/730,294

(22) Filed: Dec. 8, 2003

(65) Prior Publication Data

US 2005/0124178 A1 Jun. 9, 2005

(51) Int. Cl.[7] ..... H01R 33/00
(52) U.S. Cl. ..... 439/34; 439/8; 248/343; 248/921
(58) Field of Search ..... 439/8, 34, 36; 248/917, 921, 923, 343; 348/837

(56) References Cited

U.S. PATENT DOCUMENTS 4,566,663 A * 1/1986 Barchus ..... 248/324
5,177,616 A * 1/1993 Riday ..... 348/837
5,845,885 A * 12/1998 Carnevali ..... 248/181.1
6,087,953 A * 7/2000 DeLine et al. ..... 340/815.4
6,273,383 B1 * 8/2001 Oddsen, Jr. ..... 248/286.1

* cited by examiner

*Primary Examiner*—P. Austin Bradley
*Assistant Examiner*—James R. Harvey
(74) *Attorney, Agent, or Firm*—Bill Panagos

(57) ABSTRACT

A dockable connection assembly attached to the ceiling of a motor vehicle so that passengers can enjoy watching a display monitor at desired and comfortable angles while still being able to access the electrical components of the display screen and its counterparts in video technology. This structure allows for the screen to move at all angles, whether it be up, down, clockwise, or counterclockwise. The structure also has a safety feature that will allow for disengagement in case of emergency situations. This dockable connection assembly comprises a retainer assembly, a connector assembly, and a harness assembly. The retainer assembly provides the support for the entirety of the dockable connection assembly by holding the connector assembly and the display monitor onto the ceiling. The connector assembly provides for the electric connection a point of contact and allows for the rotation of the display monitor.

11 Claims, 1 Drawing Sheet

DOCKABLE CONNECTION ASSEMBLY

FIELD OF THE INVENTION

This present invention relates to an assembly for mounting display screens to the ceiling of a motor vehicle while providing a dockable connection for the display screens.

More specifically, it provides the structure for a connection system where the electrical connection is made within the dockable connection assembly.

BACKGROUND OF THE INVENTION

Display screens have become very popular in passenger motor vehicles. These screens allow passengers to enjoy entertainment while riding in the vehicle. The screens are typically mounted to the ceiling of motor vehicles generally in front of the passenger seating area and can either have the display screen fixedly mounted to the ceiling of the motor vehicle or can allow for some slight movement of the screen. For example, many screens pivot 180 degrees around an axis for stowing the screen flat against the vehicles' ceiling and then pulling the screen down again for viewing. Consumers have liked this feature because the screen can then be accessed only when needed. Other screens have built in features that provide passengers with a wide variety of entertainment options, such as video game input jacks, VHS input jack, DVD input jacks, television antenna, etc.

One problem these screens and their counterparts in video technology have is that the electrical connections are often difficult to access because they often run up inside the ceiling and into side panels of the motor vehicle. As a result, there has been a demand for a dockable connection that makes the electrical connections in a more convenient location. Known display screens have not been able to meet consumer demand. The present invention acknowledges consumer demand and allows the electrical connection to happen within the dockable connector assembly. As a result, the electrical components are more easily accessed for repair or upgrades. This invention solves the problem of difficult to reach electrical components while maintaining comfortable viewing positions for passengers.

SUMMARY OF THE INVENTION

A dockable connection assembly for a motor vehicle in accord with the invention comprises a retainer assembly, a connection assembly, and a harness assembly. This dockable connection assembly is rotatably associated with a display screen providing for rotation of the screen in all directions, whether it be up and down or clockwise and counterclockwise. This dockable connection assembly is further able to disengage itself in cases of emergency situations such as head on impact.

The dockable connection assembly is preferably mounted to the ceiling of a motor vehicle in a position somewhat generally in front of the passenger seating area.

In accord with an aspect of this invention, the retainer assembly further comprises a retainer and a threaded tube with index. The retainer is preferably mounted to the ceiling with the tube connector molded to it. The connection assembly is attached to retainer assembly and further comprises of a snap ball joint, a male and a female connector, a lock ring, and a snap nut. The connection assembly is connected to the retainer assembly by properly positioning the female connector with the index in the tube connector. The snap nut is then tightened over the tube connector to firmly secure the connection assembly to the retainer assembly.

The display monitor is suspended from the ceiling of a motor vehicle by way of this dockable connection assembly. The snap ball joint is molded into the screen and this provides for the connection assembly to be attached to the display screen.

In accord with another aspect of this invention, the harness assembly runs through the ceiling into the mounted retainer assembly and makes a connection within the connection assembly. This harness assembly comprises of wire causing the connection to be electrical. Once this connection is made within the connector assembly, the screen will begin to play.

The described dockable connection assembly thus provides for a plug and play method of connecting display screens in motor vehicles. A user can then plug the parts of the connection assembly together to allow the screen to play. This dockable connection assembly allows users to more readily access electrical components of the display screen or other counterparts in video technology while still enjoying the benefits of a swiveling display screen.

These and other objects and advantages of the present invention will be more readily understood after a consideration of the drawings and the detailed description of the preferred embodiment which follows.

DETAILED DESCRIPTION OF THE PREFERRED EMBODIMENT

Figure 1:
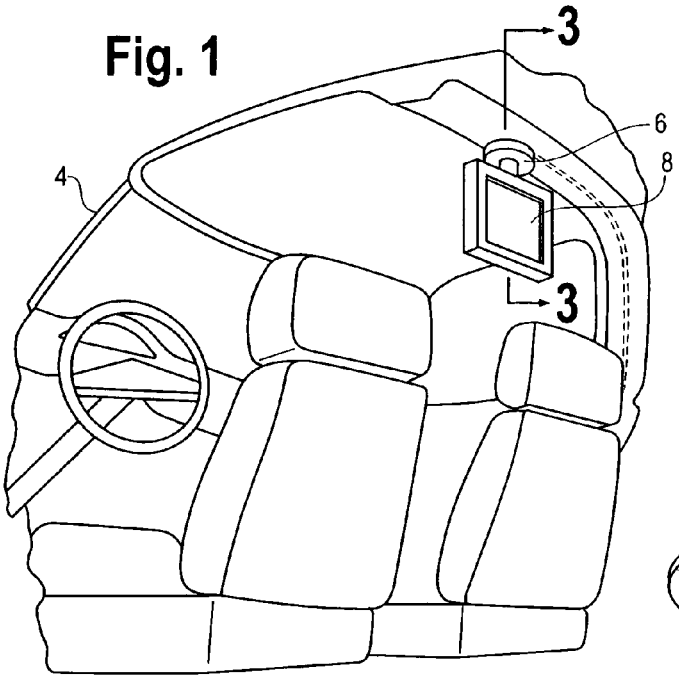
FIG. 1 is a side rear view of a display screen mounted with the dockable connector assembly within the motor vehicle.

Illustrated in FIG. 1 is the display screen 8 mounted to the ceiling of a motor vehicle 4 by the dockable connection assembly 6. Those skilled in the art will understand that the dockable connection assembly provides the point of electrical connection for the display screen 8 within the connection assembly 28. This point of electrical connection can also be used with the display screen's 8 counterparts in video technology (not shown).

Figure 2:
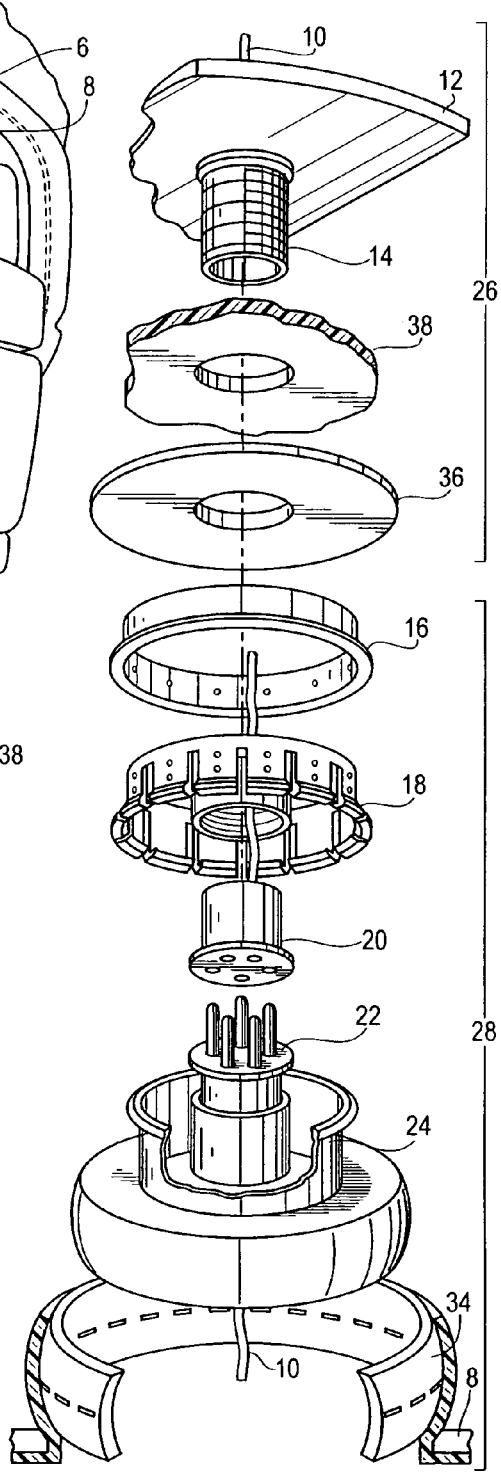
FIG. 2 is an exploded view of the dockable connector assembly.
Figure 3:
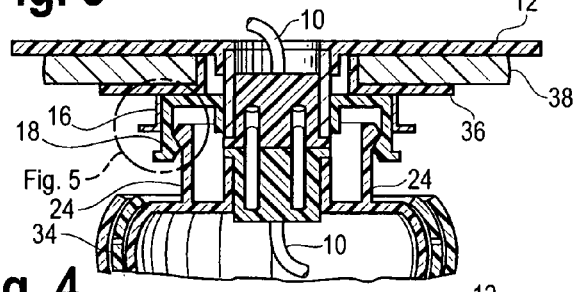
FIG. 3 is a view of the dockable connection assembly in its unlocked position.
Figure 4:
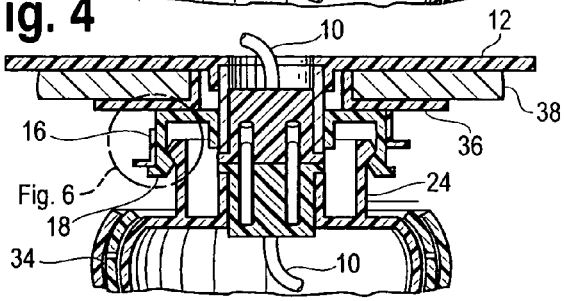
FIG. 4 is a view of the dockable connection assembly in its locked position.
Figure 5:
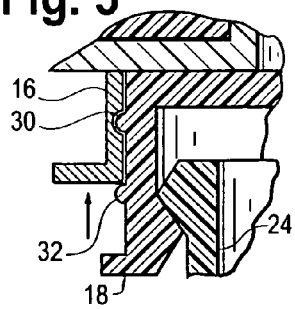
FIG. 5 is a detailed enlarged view of the unlocked position of the dockable connection assembly.
Figure 6:
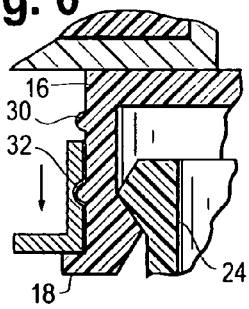
FIG. 6 is a detailed enlarged view of the locked position of the dockable connection assembly.

The retainer assembly 26 comprises an upper retainer 12, tube connector 14, and a lower retainer 36. The retainer assembly 26 is fixedly mounted to the ceiling of a motor vehicle 4 by the upper retainer 12 in a desired location, usually somewhat forward of the passenger seating area. The tube connector 14 is molded into the upper retainer 12 as seen in FIG. 2. This tube connector 14 fits through the substrate 38 of the motor vehicle 4 and then through the lower retainer 36. This lower retainer 36 serves as trim for the retainer assembly 26.

The connection assembly 28 comprises a lock ring 16, a snap nut 18, a female connector 20, a male connector 22, a snap ball joint 24, and a case 34. As depicted in FIG. 2, the snap ball joint 24 is snapped and molded into display screen 8. The case 34 fits over about three-quarters of the snap ball joint 24. It is the case 34 that allows the display screen 8 to swivel. Features can be added to the case 34 to restrict the swiveling motion.

The male connector 22 fits one end into the snap ball joint 24. The male connector 22 is then properly orientated with the female connector 20. Over the properly oriented male connector 22 and female connector 20 is the snap nut 18 and the lock ring 16. This connection assembly 28 is then fitted into the tube connector 14 by the female connector 20. The snap nut 18 is tightened around the tube connector 14 to hold the display screen 8 and connection assembly 28.

In one embodiment, when the male connector 22 and the female connector 20 are properly orientated the electrical connection will be made and the display screen 8 will to play provided that there is an electrical current. In another embodiment, the retainer assembly 26 will utilize the threaded feature on the tube connector 14 to provide for the point of electrical connection. The electrical connection can be made instead when the snap nut 18 is screwed in an upwards position to engage the dockable connection assembly 6. The electrical connection will then be disengaged when the snap nut 18 is unscrewed. Once the snap nut 18 is unscrewed from the tube connector 14, the electrical components can be easily accessed.

While the display screen 8 is engaged, the lock ring 16 is in an downward position. There are dimples 30, 32 on the snap nut 18 that keep the lock ring 16 engaged. To disengage the connection assembly 28, the lock ring 16 must be brought up over the dimples 30, 32. Once the lock ring 16 is up, the connection assembly 28 and display screen 8 may be removed. Users may at times want the dockable connection assembly 6 to be disengaged so that components may be repaired and replaced.

A harness assembly 10 runs through the dockable connection assembly 6. The harness assembly 10 comprises of wire and provides for the electrical current of the display screen 8 and/or its counterparts in video technology (not shown). The electrical current will run through this harness assembly 10 originating at some point in the motor vehicle 4 and travel to the dockable connector assembly 6. Once the dockable connection assembly 6 is fully assembled and operational, the harness assembly 10 will provide for the electrical connection that occurs in cases when the male connector 22 is properly orientated with the female connector 20 or in other cases when the snap nut 18 is screwed on the tube connector 14.

The dockable connection assembly 6 also allows for quick disengagement in case of an emergency, such as head on impact while in the motor vehicle 4 or in the instance that it is bumped while a passenger is moving within the motor vehicle 4. A safety feature on the preferred embodiment of this invention is that the case 34 is slotted. These slots control the effort of disengagement. So, if the display screen 8 is hit, the case 34 will provide for the display screen 8 to fall away from the rest of the dockable connection assembly 6. Therefore, if the display screen 8 makes contact with a person or an object it will safely disengage from the dockable connection assembly 6 with minimal injury.

The above presents a description of the best mode contemplated for carrying out this invention. The claims should not be read as limited to the described order or elements unless stated to that effect. Therefore, all embodiments that come with the scope and spirit of the following claims and equivalents thereto are claimed as the invention.

What is claimed is:

1. In a motor vehicle having a ceiling and a passenger seating area, a dockable connection assembly for a display screen comprising:

a retainer assembly;

a connector assembly adapted for pivotal and rotational attachment of the display screen and to disengage from the display screen during emergency situations; and a harness assembly adapted for establishing an electrical connection with the display screen, said harness assembly extending through said connector assembly;

wherein said retainer assembly includes a tube connector and said connector assembly includes a snap nut threadably attached to said tube connector, wherein said harness assembly runs through said retainer assembly and said connector assembly, wherein said harness assembly is adapted to establish the electrical connection with the display screen as said snap nut is threaded onto said tube connector, and is also adapted to disengage from said electrical connection with the display screen when said snap nut is unscrewed from said tube connector.

2. The dockable connection assembly of claim 1, wherein said dockable connection assembly is generally forward of said passenger seating area.

3. The dockable connection assembly of claim 1, wherein said dockable connection assembly is mounted to said ceiling.

4. The dockable connection assembly of claim 1, wherein said retainer assembly further comprises an upper retainer mounted to th ceiling of said motor vehicle, a tube connector with an index, and a lower retainer; said connection assembly further comprises a snap ball joint installed into a male connector by a receiving hole of said snap ball joint, said male connector properly orientated with a female connector, a lock ring slipped onto a snap nut fitted over said male connector properly oriented with said female connector, and a case fitted over said snap ball joint.

5. The dockable connector assembly of claim 4, wherein said tube connector is threaded on the outer portion of said tube connector.

6. The dockable connection assembly of claim 4, wherein said connection assembly is pressed into said tube connector by said female connector of said connection assembly and held firmly into said tube connector by tightening said snap nut of said connection assembly around said tube connector.

7. The dockable connection assembly of claim 4, wherein said tube connector utilizes said index to correct positioning of said connection assembly within said retainer assembly.

8. The dockable connection assembly of claim 4 wherein said snap ball joint is molded and snapped into said display monitor and said case around said snap ball joint allows said display screen to swivel.

9. The dockable connection assembly of claim 8, wherein said case can have features to restrict swiveling motion of said display screen.

10. The dockable connection assembly of claim 1, wherein said harness assembly comprises a wire.

11. The dockable connection assembly of claim 1, wherein said harness assembly runs through said retainer assembly and said harness assembly includes at least one of a male connector and a female connector disposed within said connection assembly.

* * * * *